United States Patent [19]

Danielak

[11] 4,114,824

[45] Sep. 19, 1978

[54] PAPER HOLDER

[76] Inventor: Joseph H. Danielak, 2762 Poland St., Hamtramck, Mich. 48212

[21] Appl. No.: 722,994

[22] Filed: Sep. 13, 1976

[51] Int. Cl.[2] ..... A47K 10/22

[52] U.S. Cl. ..... 242/55.53

[58] Field of Search ..... 242/55.53, 55.2, 55.3

[56] References Cited

U.S. PATENT DOCUMENTS

| | | | |
|---|---|---|---|
| 438,567 | 10/1890 | Wheeler | 242/55.2 |
| 1,311,758 | 7/1919 | Cowan, Jr. | 242/55.53 |
| 1,432,194 | 10/1922 | Liddell | 242/55.2 |
| 1,745,771 | 2/1930 | Sherwood | 242/55.53 |
| 1,973,354 | 9/1934 | Nedberg | 242/55.2 X |
| 2,080,986 | 5/1937 | Pierce | 242/55.53 X |
| 3,584,817 | 6/1971 | Bolger | 242/55.53 |
| 3,623,676 | 11/1971 | Eckels | 242/55.53 |

FOREIGN PATENT DOCUMENTS

| | | | |
|---|---|---|---|
| 1,294,626 | 5/1969 | Fed. Rep. of Germany | 242/55.2 |
| 55,959 | 12/1935 | Norway | 242/55.2 |

*Primary Examiner*—George F. Mautz

*Attorney, Agent, or Firm*—Harness, Dickey & Pierce

[57] ABSTRACT

A holder for rolls of paper, such as toilet tissue, has vertically extending tracks that receive pin ends of a roll holding spindle whereby the weight of the roll and spindle bears against a lip of the holder to hold the roll in place during tear-off of a length of paper.

1 Claim, 6 Drawing Figures

PAPER HOLDER

BRIEF SUMMARY OF THE INVENTION

It is the purpose of this invention to provide a holder for rolls of paper, such as toilet tissue, that is of economical construction and which increases the ease of paper tear-off and of insertion and removal of the roll as compared with conventional paper holders now in use.

The invention accomplishes this purpose by means of a holder that has tracks to rotatably and slidably receive pins on the ends of a paper holding spindle thereby making it very easy to remove the spindle and to insert or remove a roll of paper. The tracks run vertically and permit the weight of a roll mounted on the spindle to hold the bottom of the roll against a lip or surface on the holder and this serves to resist rotation of the roll when a length of paper is removed thereby facilitating tear-off.

DESCRIPTION OF THE INVENTION

Figure 1:
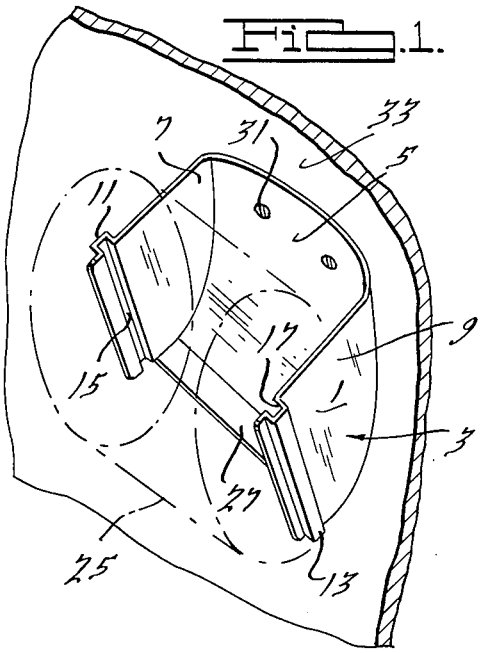
FIG. 1 is a perspective view of one form of holder embodying the invention, showing it secured to a wall and showing a roll of toilet tissue in perspective.
Figure 2:
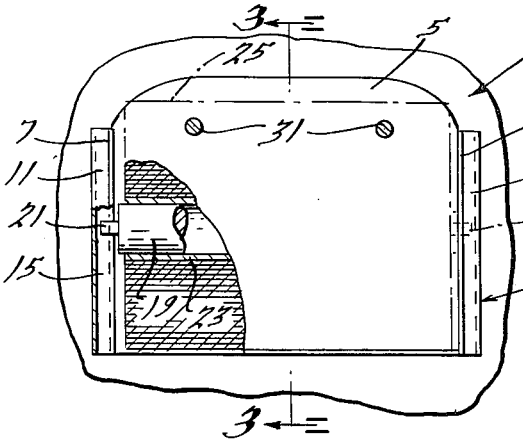
FIG. 2 is a front elevation of the holder of FIG. 1 with parts broken away.
Figure 3:
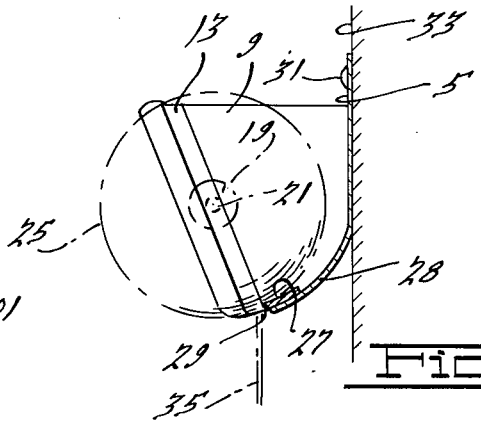
FIG. 3 is a cross section along the line 3—3 of FIG. 2.

The holder 1 may be in the form of a body or frame formed from sheet metal or molded from suitable plastic materials and has a flat back portion 3, a curved bottom portion 5, and a pair of flat side portions 7 and 9 extending at right angles to the back portion 3. End sections of the two side portions 7 and 9 are formed with outwardly extending U-shaped portions 11 and 13, the interiors of which define parallel tracks or slots 15 and 17. The tracks extend vertically and are also slanted so that their bottom ends are closer to the back portion 3 than their top ends.

A cylindrical spindle 19 has pins 21 projecting from opposite ends and the spindle and pins are dimensioned to enable the pins to move freely up and down the tracks 15 and 17. The body 21 of the spindle slidably fits inside the conventional tubular core 23 of the tissue roll 25 and therefore supports it for vertical and rotary movement in the tracks. Preferably, a strip 27 of relatively high friction material (such as rubber, etc.) is secured to the bottom 28 of back portion 3, as by an adhesive, adjacent the end edge 29 of the bottom and provides a lip or support surface against which the bottom of the paper roll 25 is continuously pressed by the force of gravity.

In use, the back 3 of the holder 1 may be secured by screws 31 to the surface of a wall 33. The spindle 19 is projected through the core 23 of a roll 25 and the assembly inserted in the holder by allowing the spindle pins 21 to enter the open top ends (FIG. 1) of the tracks 15 and 17. The roll will seat on strip 27 and its weight will bear against it to resist turning when the projecting end 35 of the roll is pulled sharply to remove it from the roll.

Figure 4:
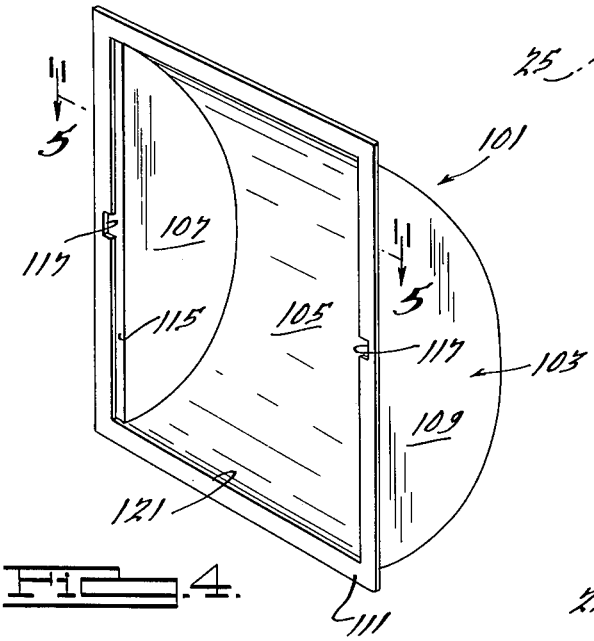
FIG. 4 is a perspective view of another form of holder embodying the invention.
Figure 5:
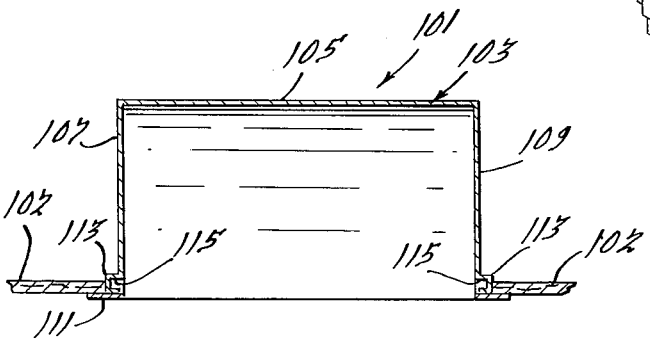
FIG. 5 is a cross section along the line 5—5 of FIG. 4.

FIGS. 4 and 5 show a holder 101 embodying the invention which is suitable for mounting flush with the surface of a wall 102, the holder having an arcuate body 103 formed of sheet metal or plastic that will fit in a recess in the wall. The body 103 includes a curved back wall 105 and sidewalls 107 and 109 and a flat circumferential mounting flange 111 extending outwardly from the back and sides and integral with the body 103 for engaging the wall surface around the recess to provide a trim mounting. The front edges of the sidewalls 107 and 109 extend vertically and have outwardly extending vertical U-shaped sections 113 formed therein, the insides of which form tracks 115 corresponding to tracks 15 and 17 of holder 1. Slots 117 are formed in the flange 111 and sections 113 to permit insertion of the spindle pins 21 into the tracks. After the spindle with a roll of paper mounted therein is inserted into the tracks, approximately one half of the roll will be in substantially semi-cylindrical chamber 119 formed by the sidewalls and back of the holder and the roll will continuously rest on the bottom of the wall 105 including the lip or support surface 121 at the bottom front of the holder. Thus, the weight of the roll will resist its rotation and that plus the action of the lip 121 will facilitate tear-off of a length of paper from the roll.

Figure 6:
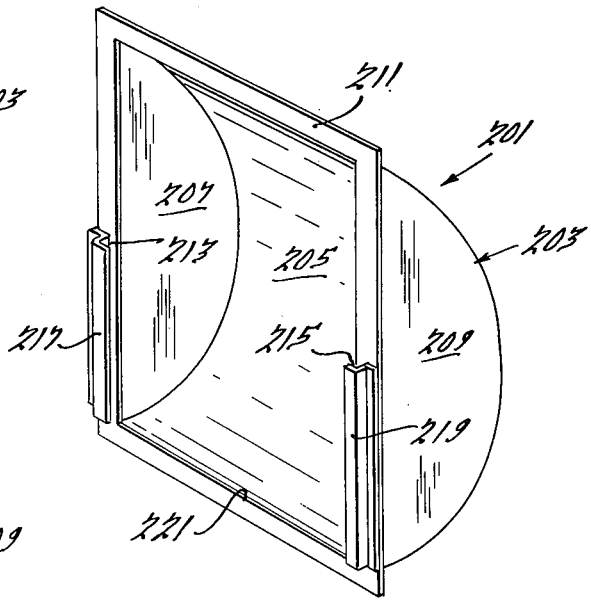
FIG. 6 is a view similar to FIG. 4 but showing a different track structure in a similar form of holder.

In FIG. 6, the holder 201 is substantially the same as holder 101 except for the track construction. In this form the holder also has an arcuate body 203 with a backwall 205 and sidewalls 207 and 209 and a mounting rim 211. The tracks 213 and 215 are formed by insides of Z-shaped strips 217 and 219 which are secured to the face of the rim 211, and which are secured to and extend along approximately one half the height of the rim. The pins at the ends of the spindle can be dropped into the open top ends of the strips 217 and 219. The roll will then continuously rest on the bottom surface or lip 221 of the back wall 205 to facilitate tear-off as described above.

In the holders 1 and 201 the inner edge of the bottom of the holder (i.e., lips 29 and 221) are close enough to the tracks so that the spindle cannot fall out of the holder when the tissue is all used, that is the lips are less than a core radius away from the tracks. In holder 101 the tracks have a bottom but the lip 121 is placed less than a radius away from them so that, like holders 1 and 201, it wll hold the spindle up when the tissue is used.

I claim:

1. A holder for an annular roll of toilet paper having a core and comprising a body having a back portion and a front portion, one of said portions being adapted to engage a vertical surface on which the holder is to be mounted, said front portion including parallel vertically extending tracks at opposite sides thereof, a spindle with a body to extend through said core and having pins of much smaller diameter than the spindle projecting outwardly at opposite ends to ride in said tracks, said spindle body being of less length than the space between the tracks, said tracks having means providing openings therein to receive spindle pins, said holder having a bottom portion engageable with the outside of a roll and extending to substantially within a spindle radius of the bottom ends of said tracks to serve as means to prevent the spindle from falling by gravity out of said tracks when all paper has been removed from the roll, said front portion comprising a rectangular frame adapted to engage a vertical surface and defining a substantially rectangular opening, said vertical tracks being a part of said frame, said back portion and bottom portion being combined into a substantially semi-cylindrical rearwardly extending portion extending from the top to the bottom of the front portion, said holder including sidewalls between said combined back and bottom portion and said front portion, said sidewalls having vertical channels formed therein adjacent their front edges and providing said tracks, the front of the tracks and the vertical sides of the frame each having an opening at substantially its vertical midpoint to permit insertion of said spindle pins into said channel tracks, said holder being symmetrical with respect to a line through said spindle receiving openings.

* * * * *